US009405245B2

(12) United States Patent
Yamagishi et al.

(10) Patent No.: US 9,405,245 B2
(45) Date of Patent: Aug. 2, 2016

(54) FIXING DEVICE COMPRISING DEFORMATION PREVENTING MEMBER FOR PREVENTING DEFORMATION OF FIXING BELT AND IMAGE FORMING APPARATUS INCLUDING SAME

(71) Applicant: KYOCERA Document Solutions Inc., Osaka (JP)

(72) Inventors: Yoshihiro Yamagishi, Osaka (JP); Satoshi Ishii, Osaka (JP); Takashi Eiki, Osaka (JP); Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/925,396

(22) Filed: Oct. 28, 2015

(65) Prior Publication Data

US 2016/0132004 A1 May 12, 2016

(30) Foreign Application Priority Data

Nov. 7, 2014 (JP) ..... 2014-227117

(51) Int. Cl.
*G03G 15/20* (2006.01)

(52) U.S. Cl.
CPC ..... *G03G 15/2053* (2013.01)

(58) Field of Classification Search
CPC ..... G03G 15/2039; G03G 15/2046; G03G 15/205; G03G 15/2053
USPC ..... 399/33, 69, 329
See application file for complete search history.

(56) References Cited

U.S. PATENT DOCUMENTS 8,831,497 B2 * 9/2014 Yokoyama ..... G03G 15/2053 399/69
8,971,735 B2 * 3/2015 Yoshimura ..... G03G 15/205 399/33
2013/0195477 A1 8/2013 Seshita et al.

FOREIGN PATENT DOCUMENTS

JP 2013-178472 A 9/2013

* cited by examiner

*Primary Examiner* — William J Royer
(74) *Attorney, Agent, or Firm* — Studebaker & Brackett PC

(57) ABSTRACT

A fixing device includes a fixing belt, a pressuring member, a heat source, a pressing member, a heating stop device and a deformation preventing member. The deformation preventing member is configured to face an inner circumferential face of the fixing belt. In a state where the fixing belt is not broken in a circumferential direction, the fixing belt and the deformation preventing member are arranged at an interval, and when the fixing belt is broken in the circumferential direction, the fixing belt is deformed and comes into contact with the deformation preventing member so that the fixing belt is prevented from being deformed to a side far from the heating stop device.

10 Claims, 7 Drawing Sheets

FIXING DEVICE COMPRISING DEFORMATION PREVENTING MEMBER FOR PREVENTING DEFORMATION OF FIXING BELT AND IMAGE FORMING APPARATUS INCLUDING SAME

INCORPORATION BY REFERENCE

This application is based on and claims the benefit of priority from Japanese Patent application No. 2014-227117 filed on Nov. 7, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet.

For example, there is a fixing device including a fixing belt, a pressuring member configured to come into pressure contact with the fixing belt so as to form a fixing nip, a heat source configured to heat the fixing belt, and a heating stop device configured to face an outer circumferential face of the fixing belt. In such a fixing device, upon an excessive rise in temperature of the fixing belt, the heating stop device operates so as to stop the fixing belt from heating by the heat source.

In the fixing device configured as described above, there is a concern that, when a facing interval between the fixing belt and the heating stop device is too narrow, the heating stop device operates even though the temperature of the fixing belt does not excessively rise. On the other hand, there is a concern that, when the facing interval is widened, if the fixing belt is broken in the circumferential direction, a timing at which the heating stop device operates delays.

SUMMARY

In accordance with an embodiment of the present disclosure, a fixing device includes a fixing belt, a pressuring member, a heat source, a pressing member, a heating stop device and a deformation preventing member. The fixing belt is configured to be rotatable around a rotation axis. The pressuring member is configured to be rotatable and to come into pressure contact with the fixing belt so as to form a fixing nip. The heat source is configured to heat the fixing belt. The pressing member is configured to press the fixing belt to a side of the pressuring member. The heating stop device is configured to face an outer circumferential face of the fixing belt and to operate at an operating temperature so as to stop the heat source from heating the fixing belt. The deformation preventing member is configured to face an inner circumferential face of the fixing belt. In a state where the fixing belt is not broken in a circumferential direction, the fixing belt and the deformation preventing member are arranged at an interval, and when the fixing belt is broken in the circumferential direction, the fixing belt is deformed and comes into contact with the deformation preventing member so that the fixing belt is prevented from being deformed to a side far from the heating stop device.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Figure 1:
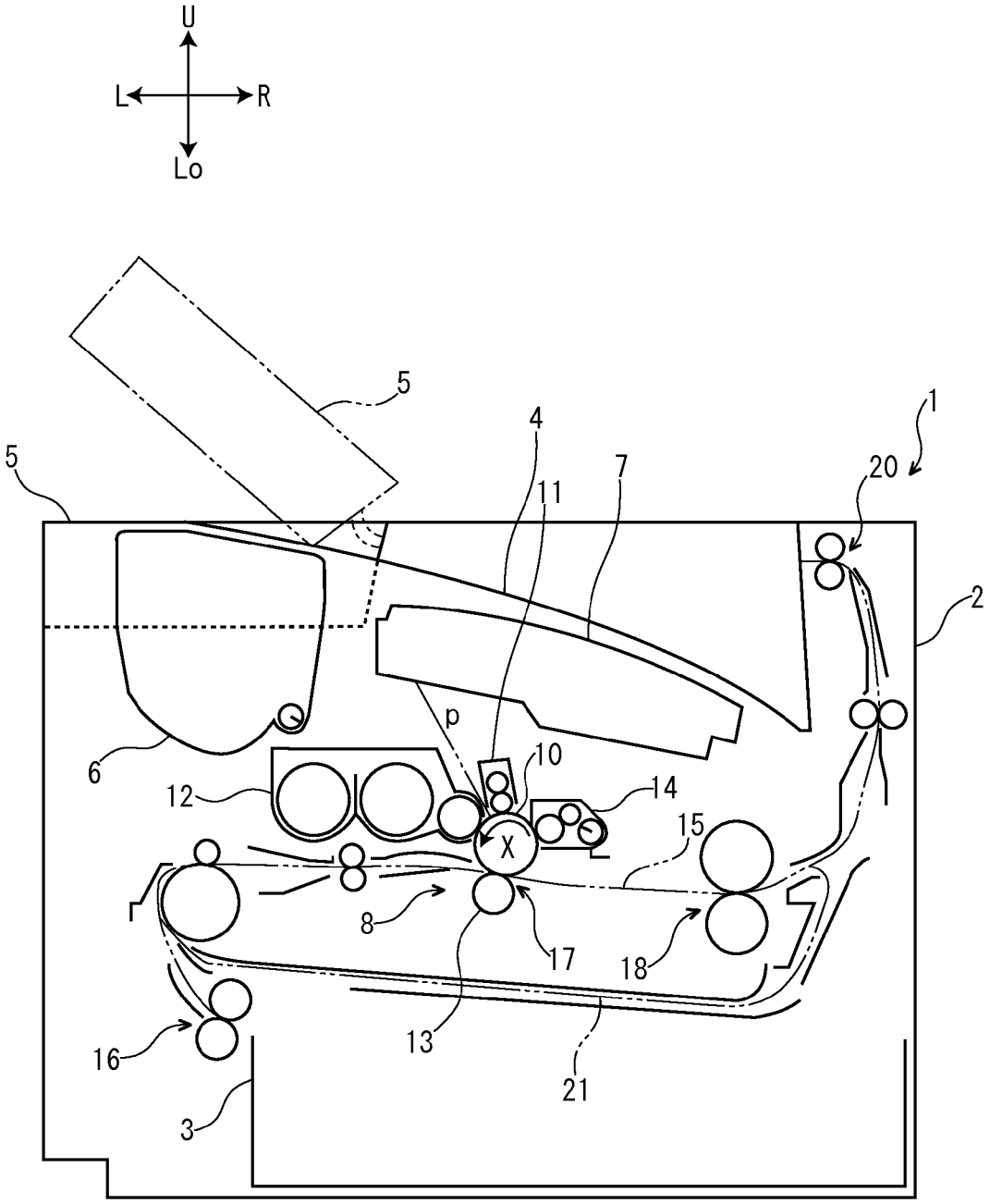
FIG. 1 is a schematic diagram showing a printer according to one embodiment of the present disclosure.

First, with reference to FIG. 1, the entire structure of an electrographic printer 1 (an image forming apparatus) will be described. Hereinafter, it will be described so that the front side of the printer 1 is positioned at the front side of FIG. 1. Arrows Fr, Rr, L, R, U and Lo appropriately added to each of the drawings indicate the front side, rear side, left side, right side, upper side and lower side of the printer 1, respectively.

The printer 1 includes a box-formed printer main body 2. In a lower part of the printer main body 2, a sheet feeding cartridge 3 configured to store sheets (recording medium) is installed and, on the top surface of the printer main body 2, a sheet ejecting tray 4 is mounted. On the top surface of the printer main body 2, an upper cover 5 is openably/closably attached at a left-hand side of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, an image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Next, the fixing device 18 will be described in detail with reference to FIGS. 2 and 3. Arrow Y in FIG. 2 indicates a sheet conveying direction. Arrow I in FIG. 3 indicates an inside in forward and backward directions, and arrow O in FIG. 3 indicates an outside of the forward and backward directions.

Figure 2:
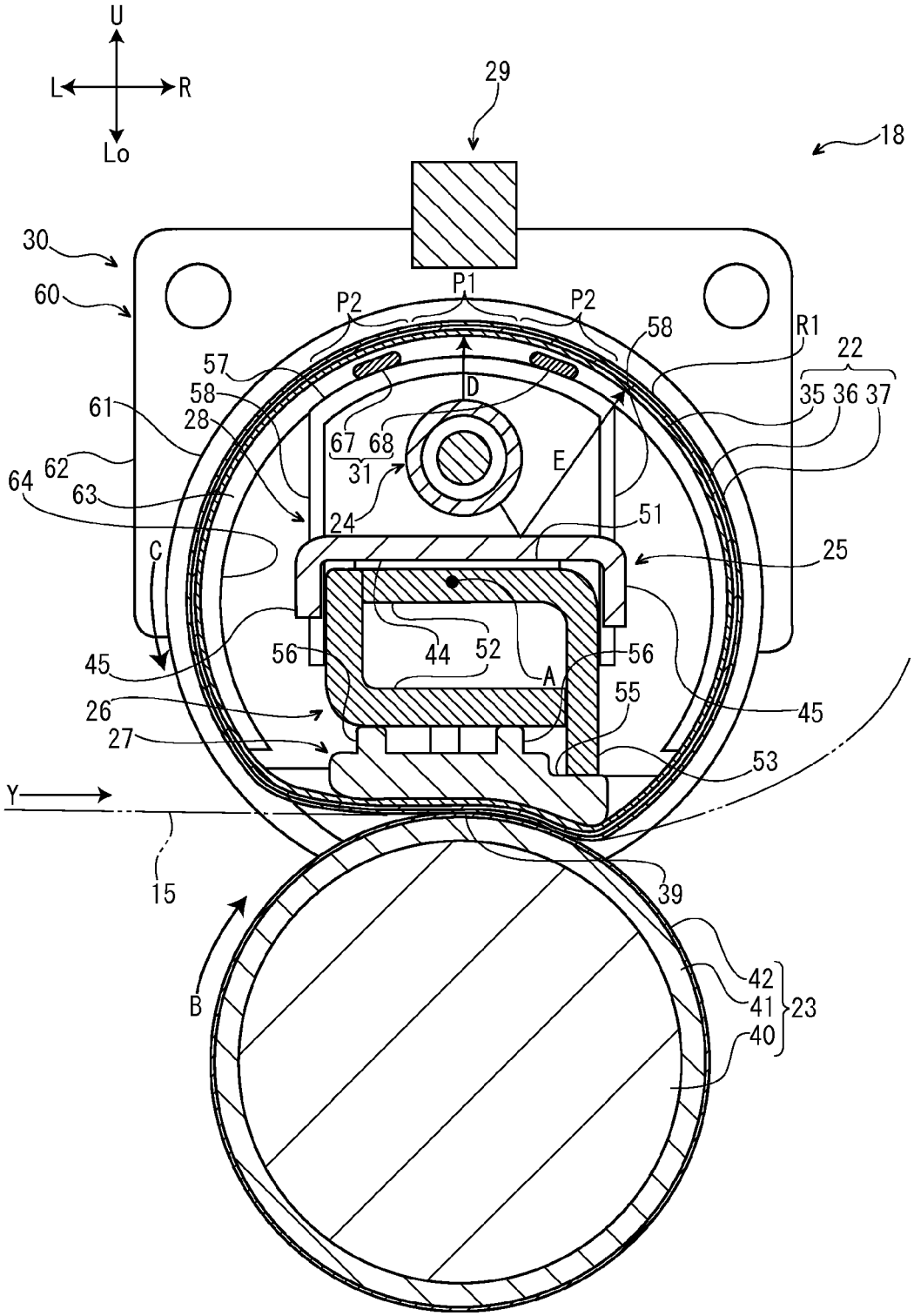
FIG. 2 is a sectional view showing a fixing device according to the one embodiment of the present disclosure.
Figure 3:
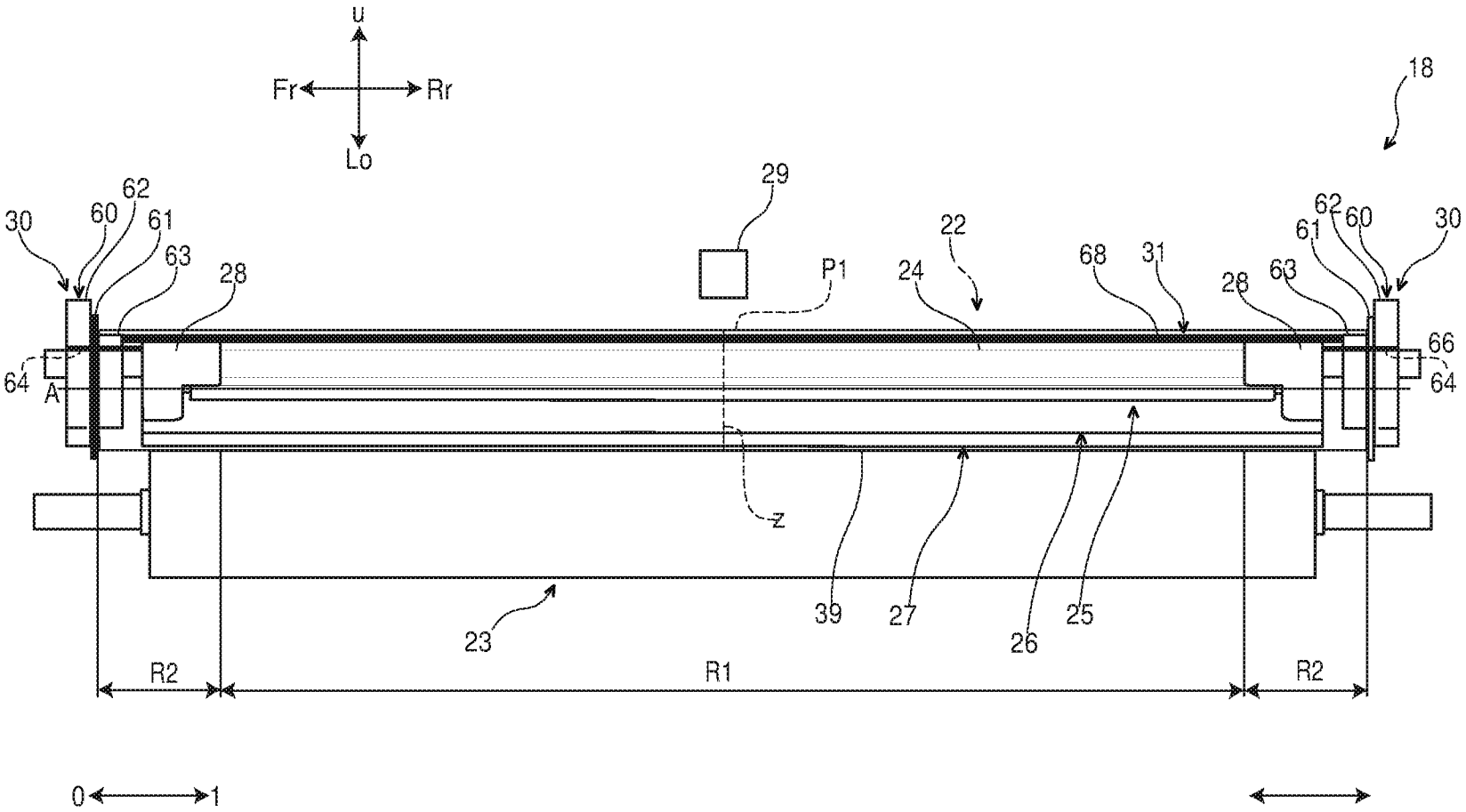
FIG. 3 is a side view showing the fixing device according to the one embodiment of the present disclosure.

As shown in FIGS. 2 and 3 and other figures, the fixing device 18 includes a fixing belt 22, a pressuring roller 23 (pressuring member) which is arranged below (outside) the fixing belt 22, a heater 24 (heat source) which is arranged at an inner diameter side of the fixing belt 22, a reflecting plate 25 (reflecting member) which is arranged at the inner diameter side of the fixing belt 22 and below the heater 24, a supporting member 26 which is arranged at the inner diameter side of the fixing belt 22 and below the reflecting plate 25, a pressing member 27 which is arranged at the inner diameter side of the fixing belt 22 and below the supporting member 26, cover members 28 which are fixed to both front and rear end parts of the supporting member 26 at the inner diameter side of the fixing belt 22, a thermocut 29 (heating stop device) which is arranged above (outside) the fixing belt 22, shape restricting members 30 which are attached to the both front and rear end parts of the fixing belt 22, and a deformation preventing member 31 which is arranged at the inner diameter side of the fixing belt 22 and above the heater 24. In addition, FIG. 3 is a perspective view of the inside of the fixing belt 22.

The fixing belt 22 is formed in a nearly cylindrical shape elongated in the forward and backward directions. The fixing belt 22 is provided rotatably around a rotation axis A elongated in the forward and backward directions. That is, in the present embodiment, the forward and backward directions are a rotation axis direction of the fixing belt 22.

The fixing belt 22 has flexibility, and is endless in a circumferential direction. The fixing belt 22 includes a base material layer 35, an elastic layer 36 which is provided around this base material layer 35 and a release layer 37 which covers this elastic layer 36, for example. The base material layer 35 of the fixing belt 22 is made of a metal, such as SUS or nickel. In addition, the base material layer 35 of the fixing belt 22 may be made of a resin, such as a PI (polyimide). The elastic layer 36 of the fixing belt 22 is made of a silicon rubber, for example, and has a larger thermal expansion coefficient than a thermal expansion coefficient of the base material layer 35 of the fixing belt 22. The thickness of the elastic layer 36 of the fixing belt 22 is 270 μm, for example. The release layer 37 of the fixing belt 22 is made of a PFA tube, for example. The thickness of the release layer 37 of the fixing belt 22 is 20 μm, for example.

At an upper part (a part at a far side from the pressuring roller 23) of the fixing belt 22, a first part P1 and second parts P2 formed on both of left and right sides of the first part P1 are formed. The first part P1 is positioned at an upper end part of the fixing belt 22, and the first part P1 of the fixing belt 22 is the closest to the heater 24. Each of the second parts P2 is slightly farther from the heater 24 than the first part P1.

The fixing belt 22 includes a sheet passing region R1 and non-sheet passing regions R2 which are provided at both front and rear sides (an outside in the forward and backward directions of the sheet passing region R1) of the sheet passing region R1. The sheet passing region R1 is a region through which sheets of a maximum size pass. Each of the non-sheet passing regions R2 is a region through which the sheets of the maximum size do not pass.

The pressuring roller 23 is formed in a nearly columnar shape elongated in the forward and backward directions. The pressuring roller 23 comes into pressure contact with the fixing belt 22 so as to form a fixing nip 39 between the fixing belt 22 and the pressuring roller 23. The pressuring roller 23 is rotatably provided.

The pressuring roller 23 includes a columnar core material 40, an elastic layer 41 which is provided around this core material 40 and a release layer 42 which covers this elastic layer 41, for example. The core material 40 of the pressuring roller 23 is made of a metal, such as an iron. The elastic layer 41 of the pressuring roller 23 is made of a silicon rubber, for example. The release layer 42 of the pressuring roller 23 is made of a PFA tube, for example.

The heater 24 is configured as a halogen heater, for example. The heater 24 is arranged at an upper part (a part at a far side from the pressuring roller 23) in an internal space of the fixing belt 22, and is provided at a position displaced upward (the far side from the pressuring roller 23) from the rotation axis A of the fixing belt 22.

The reflecting plate 25 is formed in a shape elongated in the forward and backward directions. The reflecting plate 25 is made of a metal, such as an aluminum alloy for brightness. The reflecting plate 25 is arranged between the heater 24 and the supporting member 26. A cross section of the reflecting plate 25 is formed in a U shape which protrudes upward (a far side from the pressuring roller 23).

The reflecting plate 25 includes a main body part 44 which is provided nearly horizontally, and guide parts 45 which are bent downward from both left and right end parts (end parts at an upstream side and a downstream side in the sheet conveying direction Y) of the main body part 44. A top face of the main body part 44 is a reflection face (mirror face) which faces the heater 24, and reflects a radiation heat radiated from the heater 24, to an inner circumferential face of the fixing belt 22.

The supporting member 26 is formed in a shape elongated in the forward and backward directions. An upper part of the supporting member 26 is inserted between the guide parts 45 of the reflecting plate 25. The supporting member 26 supports the reflecting plate 25 via a spacer 51, and is not in direct contact with the reflecting plate 25. The supporting member 26 is formed by combining a pair of L-shaped sheet metals 52, and has a nearly rectangular cross-sectional shape. At a lower right corner part of the supporting member 26, an engaging protrusion 53 which protrudes downward is formed. The engaging protrusion 53 is formed by elongating one of the sheet metals 52 downward.

The pressing member 27 is formed in a long flat shape in the forward and backward directions. The pressing member 27 is made of a heat-resistant resin, such as an LCP (Liquid Crystal Polymer). At a right end part of a top face of the pressing member 27, an engaging convex part 55 is formed. The engaging convex part 55 engages with the engaging protrusion 53 of the supporting member 26. On the top face of the pressing member 27, a plurality of bosses 56 are formed so as to protrude. An upper end part of each boss 56 comes into contact with a lower face of the supporting member 26. According to the above-mentioned configuration, the supporting member 26 supports the pressing member 27, and restricts a warp of the pressing member 27.

A right side part (a part at a downstream side in the sheet conveying direction Y) of the lower face of the pressing member 27 is inclined downward (toward the pressuring roller 23) from the left side (an upstream side in the sheet conveying direction Y) to the right side (the downstream side in the sheet conveying direction Y). The lower face of the pressing member 27 presses the fixing belt 22 downward (toward the pressuring roller 23).

Each cover member 28 is formed in a nearly U shape when seen from a front view. A position in the forward and backward directions of each cover member 28 meets each non-sheet passing region R2 of the fixing belt 22 and has a function of blocking a radiation heat traveling from the heater 24 to each non-sheet passing region R2 of the fixing belt 22.

Each cover member 28 includes a curved part 57 which is curved upward in an arc shape, and attachment parts 58 which are bent downward from both left and right end parts (end parts at the upstream side and the downstream side in the sheet conveying direction Y) of the curved part 57. The curved part 57 is arranged along the inner circumferential face of the fixing belt 22. A lower end part of each of the attachment parts 58 is attached to each one of both left and right side faces of the supporting member 26.

The thermocut 29 is a thermostat of a bimetallic type (a type which configures a contact point by using two types of metals having different thermal expansion coefficients), for example. The thermocut 29 is arranged directly above the upper end part of the fixing belt 22 (a part of the fixing belt 22 which is the closest to the heater 24), and faces an outer circumferential face of the upper end part of the fixing belt 22. The thermocut 29 is provided at a position meeting a forward-and-backward direction center part Z (corresponding to a forward-and-backward direction center part of the entire fixing belt 22, too) of the sheet passing region R1 of the fixing belt 22).

Each shape restricting member 30 is arranged closer to the outside in the forward and backward directions than each cover member 28. Each shape restricting member 30 includes a restricting piece 60 and a ring piece 61 which is attached to the restricting piece 60.

The restricting piece 60 of each shape restricting member 30 includes a base part 62, and a restricting part 63 which is formed in a face at an inside in the forward and backward directions of the base part 62 so as to protrude. A through-hole 64 which penetrates the base part 62 and the restricting part 63 is provided to the restricting piece 60 along the forward and backward directions, and the heater 24 penetrates this through-hole 64. The restricting part 63 is curved in an arc shape along an outer circumference of the through-hole 64, and is formed in a nearly downward C shape. The restricting part 63 is inserted in the both front and rear end parts of the fixing belt 22. Consequently, the shape of the fixing belt 22 is restricted (deformation of the fixing belt 22 is prevented). The upper end part (apex) of the restricting part 63 comes into contact with the inner circumferential face of the fixing belt 22 in normal use (when the fixing belt 22 is not broken in the circumferential direction).

The ring piece 61 of each shape restricting member 30 is formed in an annular shape. The ring piece is attached to an outer circumference of the restricting part 63 of the restricting piece 60. The ring piece 61 is arranged at the outside in the forward and backward directions of the both front and rear end parts of the fixing belt 22, and restricts meandering of the fixing belt 22 (movement to the outside in the forward and backward directions). The ring piece 61 is arranged at the inside in the forward and backward directions of the base part 62 of the restricting piece 60, and thereby restricts movement of the ring piece 61 to the outside in the forward and backward directions.

The deformation preventing member 31 is provided above the rotation axis A of the fixing belt 22 and at a position except for a position directly above the heater 24. The deformation preventing member 31 is elongated in the forward and backward directions, and is provided over an entire region of the fixing belt 22 in the forward and backward directions. Both front and rear end parts of the deformation preventing member 31 are fixed to the shape restricting members 30 or are fixed to a fixing frame (not shown) which retains the shape restricting members 30. A thermal expansion rate of the deformation preventing member 31 is equal to or less than a thermal expansion rate of the base material layer 35 of the fixing belt 22.

The deformation preventing member 31 includes an upstream side part 67 which is arranged at an upper left side of the heater 24, and a downstream side part 68 which is arranged at an upper right side of the heater 24 with an interval from the upstream side part 67. The upstream side part 67 and the downstream side part 68 of the deformation preventing member 31 may be connected at a side closer to an outside in the forward and backward directions than the fixing belt 22, or may not be connected. The upstream side part 67 of the deformation preventing member 31 does not face an inner circumferential face of the first part P1 of the fixing belt 22, and faces an inner circumferential face of the second part P2 (referred to as the "left second part P2" below) provided closer to a left side (an upstream side in the sheet conveying direction Y) than the first part P1 of the fixing belt 22. The downstream side part 68 of the deformation preventing member 31 does not face the inner circumferential face of the first part P1 of the fixing belt 22, and faces the inner circumferential face of the second part P2 provided closer to the right side (a downstream side in the sheet conveying direction Y) than the first part P1 of the fixing belt 22.

Figure 4:
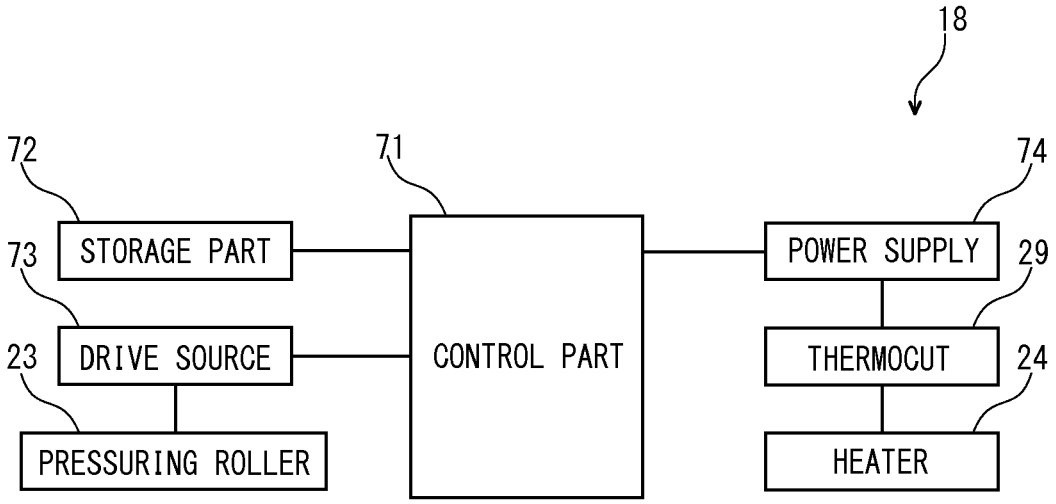
FIG. 4 is a block diagram showing a control system of the fixing device according to the one embodiment of the present disclosure.

Next, a control system of the fixing device 18 will be described with reference to FIG. 4.

The fixing device 18 includes a control part 71 (CPU). The control part 71 is connected to a storage part 72 which is configured as a storage device, such as a ROM or a RAM, and the control part 71 is configured to control each part of the fixing device 18 based on a control program or control data stored in the storage part 72. The storage part 72 stores an operating temperature T of the thermocut 29.

The control part 71 is connected to a drive source 73 configured as a motor or the like, and the drive source 73 is connected to the pressuring roller 23. Further, based on a signal from the control part 71, the drive source 73 rotates the pressuring roller 23.

The control part 71 is connected to a power supply 74, and the power supply 74 is connected to the heater 24. Further, based on a signal from the control part 71, power is supplied from the power supply 74 to the heater 24 so as to operate the heater 24. On a power supply route from the power supply 74 to the heater 24, the thermocut 29 is provided. The thermocut 29 is configured to operate at the operating temperature T, cut a power supply from the power supply 74 to the heater 24, and stop the heater 24 from heating the fixing belt 22.

To fix a toner image on a sheet in the fixing device 18 applying the above-mentioned configuration, the drive source 73 rotates the pressuring roller 23 (see arrow B in FIG. 2). When the pressuring roller 23 is rotated in this way, the fixing belt 22 which comes into pressure contact with the pressuring roller 23 is driven to rotate in a direction opposite to a direction of the pressuring roller 23 (see arrow C in FIG. 2). When the fixing belt 22 is rotated in this way, the fixing belt 22 slides against the pressing member 27.

Further, to fix a toner image on a sheet, power is supplied from the power supply 74 to the heater 24 so as to operate the heater 24. When the heater 24 is operated in this way, the heater 24 radiates a radiation heat. Part of the radiation heat radiated from the heater 24 is directly radiated on and is absorbed in the inner circumferential face of the fixing belt 22 as indicated by arrow D in FIG. 2. Further, as indicated by arrow E in FIG. 2, another part of the radiation heat radiated from the heater 24 is reflected toward the inner circumferential face of the fixing belt 22 on the top face of the main body part 44 of the reflecting plate 25, and is absorbed in the inner circumferential face of the fixing belt 22. According to the above-mentioned function, the heater 24 heats the fixing belt 22. When the sheet passes through the fixing nip 39 in this state, the toner image is heated, is melted and is fixed to the sheet.

By the way, in the fixing device 18 applying the above-mentioned configuration, even when the heater 24 stops heating the fixing belt 22 in response to the stop of the fixing belt 22, the first part P1 of the fixing belt 22 is locally heated by a remaining heat of the heater 24 and overshoots (a rise in the temperature) in some cases. There is a concern that, when a facing interval between the first part P1 of the fixing belt 22 and the thermocut 29 is too narrow, if the first part P1 of the fixing belt 22 overshoots as described above, even though the temperature of the fixing belt 22 does not excessively rise, the thermocut 29 operates. When the thermocut 29 operates once, it is difficult to restore the thermocut 29 to a state before the operation, and therefore it is generally necessary to exchange the entire fixing device 18.

To avoid such a situation, it is necessary to widen the facing interval between the first part P1 of the fixing belt 22 and the thermocut 29. However, there is a concern that, when the facing interval is widened in this way, a timing at which the thermocut 29 operates upon an excessive rise in the temperature of the fixing belt 22 delays. There is a concern that, particularly when a configuration where the pressing member 27 of a flat shape presses the fixing belt 22 downward as in the present embodiment is applied, if the fixing belt 22 is broken in the circumferential direction, the fixing belt 22 is deformed in a horizontally long elliptical shape. There is a concern that, when the fixing belt 22 is deformed in the horizontally long elliptical shape in this way, the facing interval between the first part P1 of the fixing belt 22 and the thermocut 29 further widens, and a timing at which the thermocut 29 operates further delays. Hence, in the present embodiment, even when the fixing belt 22 is broken in the circumferential direction, the thermocut 29 is operated at an adequate timing as follows.

As shown in FIG. 2, in normal use of the fixing belt 22 (when the fixing belt 22 is not broken in the circumferential direction), the left second part P2 of the fixing belt 22 and the upstream side part 67 of the deformation preventing member 31 are provided with an interval, and the right second part P2 of the fixing belt 22 and the downstream side part 68 of the deformation preventing member 31 are provided with an interval. Consequently, it is possible to prevent a heat of the fixing belt 22 from escaping to the deformation preventing member 31. According to this, the heater 24 can intensively heat the fixing belt 22, and it is possible to reduce a temperature rising time of the fixing belt 22.

Figure 5:
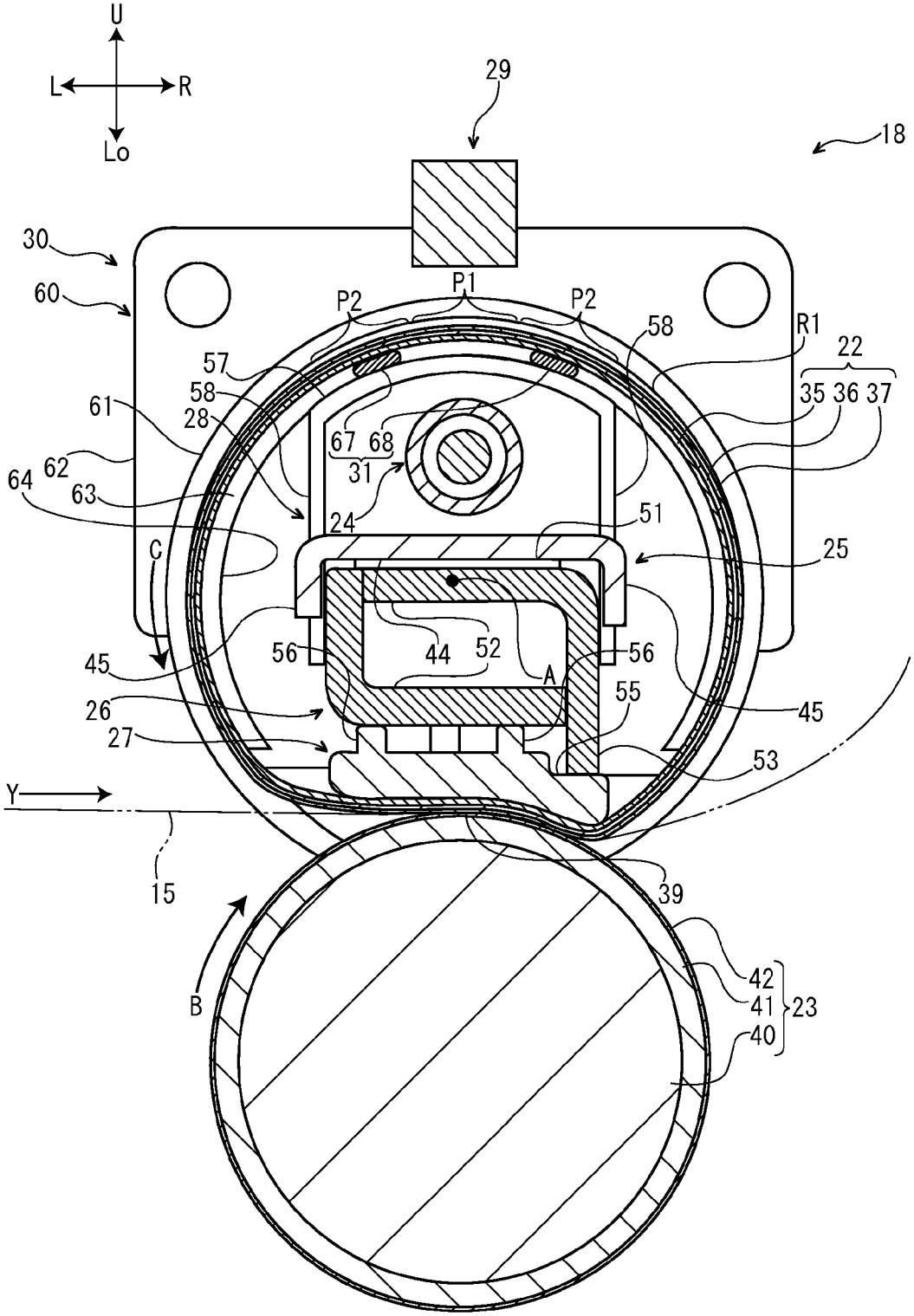
FIG. 5 is a sectional view showing a state that the fixing belt is broken in a circumferential direction in the fixing device according to the one embodiment of the present disclosure.

By contrast with this, when the fixing belt 22 is broken in the circumferential direction, as shown in FIG. 5, the upper part of the fixing belt 22 (the far side from the pressuring roller 23) is deformed downward (the far side from the thermocut 29). This deformation places the left second part P2 of the fixing belt 22 in contact with the upstream side part 67 of the deformation preventing member 31, and places the right second part P2 of the fixing belt 22 in contact with the downstream side part 68 of the deformation preventing member 31. According to this, the upper part of the fixing belt 22 is prevented from being deformed downward (the far side from the thermocut 29), and the fixing belt 22 is not deformed in the horizontally long elliptical shape.

When the heater 24 continues heating the fixing belt 22 in this state, the temperature of the fixing belt 22 rises, the temperature of the thermocut 29 facing the outer circumferential face of the first part P1 of the fixing belt 22 also rises. According to this, the temperature of the thermocut 29 reaches the operating temperature T, the thermocut 29 operates and power supply from the power supply 74 to the heater 24 is stopped. Hence, the heater 24 also stops heating the fixing belt 22.

In the present embodiment, when the fixing belt 22 is broken in the circumferential direction, the upper part of the fixing belt 22 is prevented from being deformed downward (the far side from the thermocut 29). Consequently, it is possible to prevent the facing interval between the first part P1 of the fixing belt 22 and the thermocut 29 from widening. According to this, it is possible to operate the thermocut 29 at an adequate timing.

Further, when the fixing belt 22 is broken in the circumferential direction, the upper part of the fixing belt 22 is prevented from being deformed downward (the far side from the thermocut 29), and therefore it is not necessary to narrow the facing interval between the first part P1 of the fixing belt 22 and the thermocut 29 so as not to widen the facing interval between the first part P1 of the fixing belt 22 and the thermocut 29 too much when the fixing belt 22 is broken in the circumferential direction. Consequently, it is possible to set a wide facing interval between the first part P1 of the fixing belt 22 and the thermocut 29, and avoid a situation that the thermocut 29 operates even though the temperature of the fixing belt 22 does not excessively rise.

Further, the upstream side part 67 and the downstream side part 68 of the deformation preventing member 31 do not face the inner circumferential face of the first part P1 of the fixing belt 22, and face the inner circumferential face of each of the second parts P2 of the fixing belt 22. The upstream side part 67 and the downstream side part 68 of the deformation preventing member 31 are arranged so as not to face the inner circumferential face of the first part P1 of the fixing belt 22 as described above, so that it is possible to prevent a radiation heat traveling from the heater 24 toward the first part P1 of the fixing belt 22, from being blocked by the deformation preventing member 31 (see arrow D in FIG. 2). According to this, the heater 24 can efficiently heat the fixing belt 22. Further, the upstream side part 67 and the downstream side part 68 of the deformation preventing member 31 are arranged so as to face the inner circumferential face of each of the second parts P2 of the fixing belt 22, so that it is possible to enhance a function of preventing the fixing belt 22 from being deformed.

Further, the deformation preventing member 31 is provided over the entire region of the fixing belt 22 in the forward and backward directions. By applying such a configuration, irrespective of at which position in the forward and backward directions the fixing belt 22 is broken in the circumferential direction, it is possible to reliably prevent the upper part of the fixing belt 22 from being deformed downward (the far side from the thermocut 29).

Further, the heater 24 is arranged at the inner diameter side of the fixing belt 22 and is provided at a position displaced upward (the far side from the pressuring roller 23) from the rotation axis A of the fixing belt 22, and the thermocut 29 faces the outer circumferential face of the first part P1 of the fixing belt 22 (the part of the fixing belt 22 which is the closest to the heater 24). The first part P1 of the fixing belt 22 is a part of the fixing belt 22 whose temperature is the most likely to excessively rise and therefore, by arranging the thermocut 29 so as to face the outer circumferential face of the first part P1 of the fixing belt 22 as described above, it is possible to reliably prevent an excessive rise in the temperature of the fixing belt 22.

Figure 6:
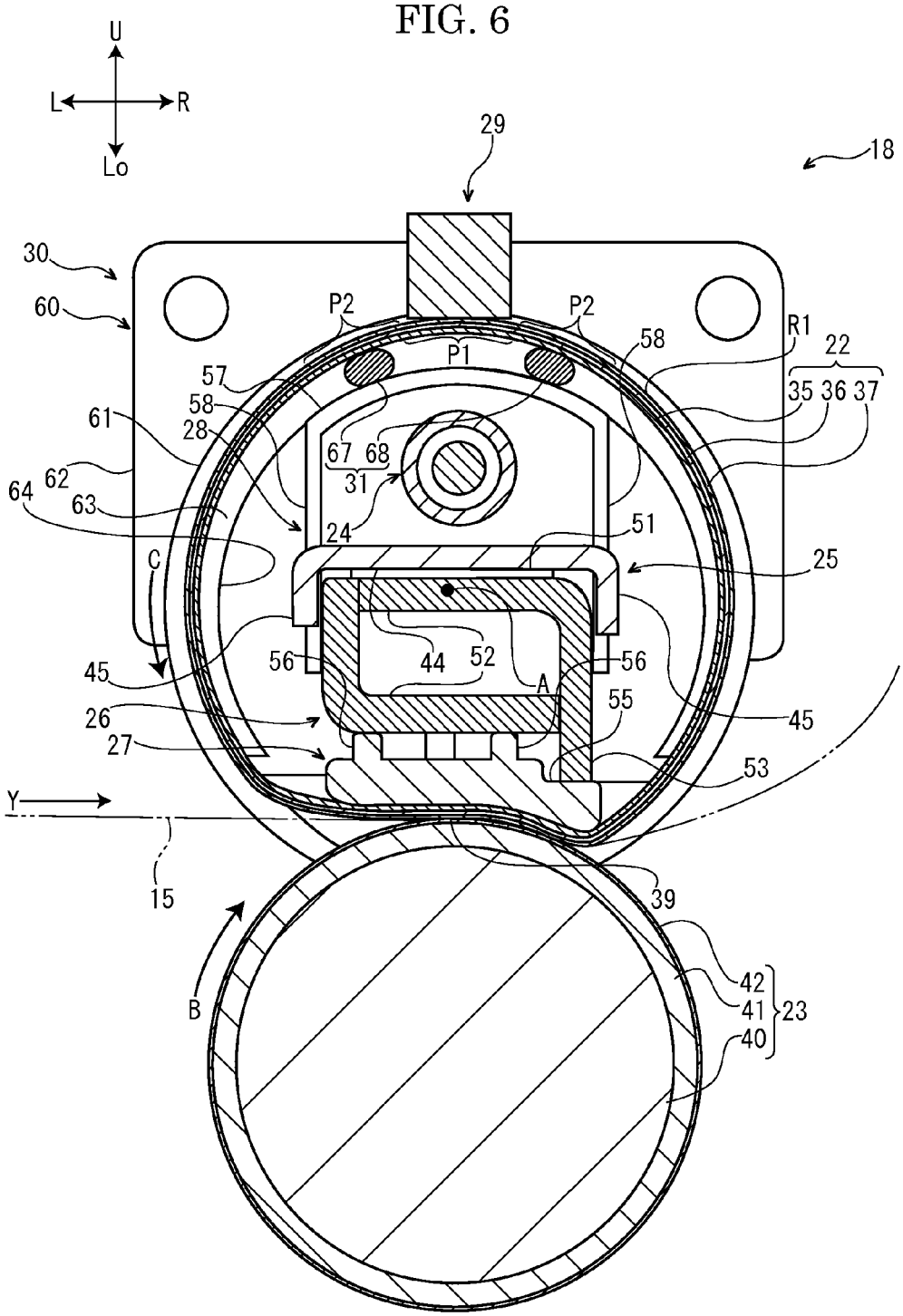
FIG. 6 is a sectional view showing a state that the fixing belt is broken in a circumferential direction in the fixing device according to another different embodiment of the present disclosure.

In the present embodiment, a case where the thermal expansion rate of the deformation preventing member 31 is equal to or less than the thermal expansion rate of the base material layer 35 of the fixing belt 22 has been described. Meanwhile, in other different embodiments, the thermal expansion rate of the deformation preventing member 31 may be larger than the thermal expansion rate of the base material layer 35 of the fixing belt 22. By applying such a configuration, when the fixing belt 22 is broken in the circumferential direction, as shown in FIG. 6, the upstream side part 67 and the downstream side part 68 of the deformation preventing member 31 are deformed by a thermal expansion, and press each of the second parts P2 of the fixing belt 22 upward (toward the thermocut 29). According to this, it is possible to place the first part P1 of the fixing belt 22 in contact with the thermocut 29, reliably operate the thermocut 29 and reliably stop the heater 24 from heating the fixing belt 22. In addition, to increase the thermal expansion rate of the deformation preventing member 31 compared to the thermal expansion rate of the base material layer 35 of the fixing belt 22, the deformation preventing member 31 is made of an aluminum and the base material layer 35 of the fixing belt 22 is made of a SUS, for example.

Figure 7:
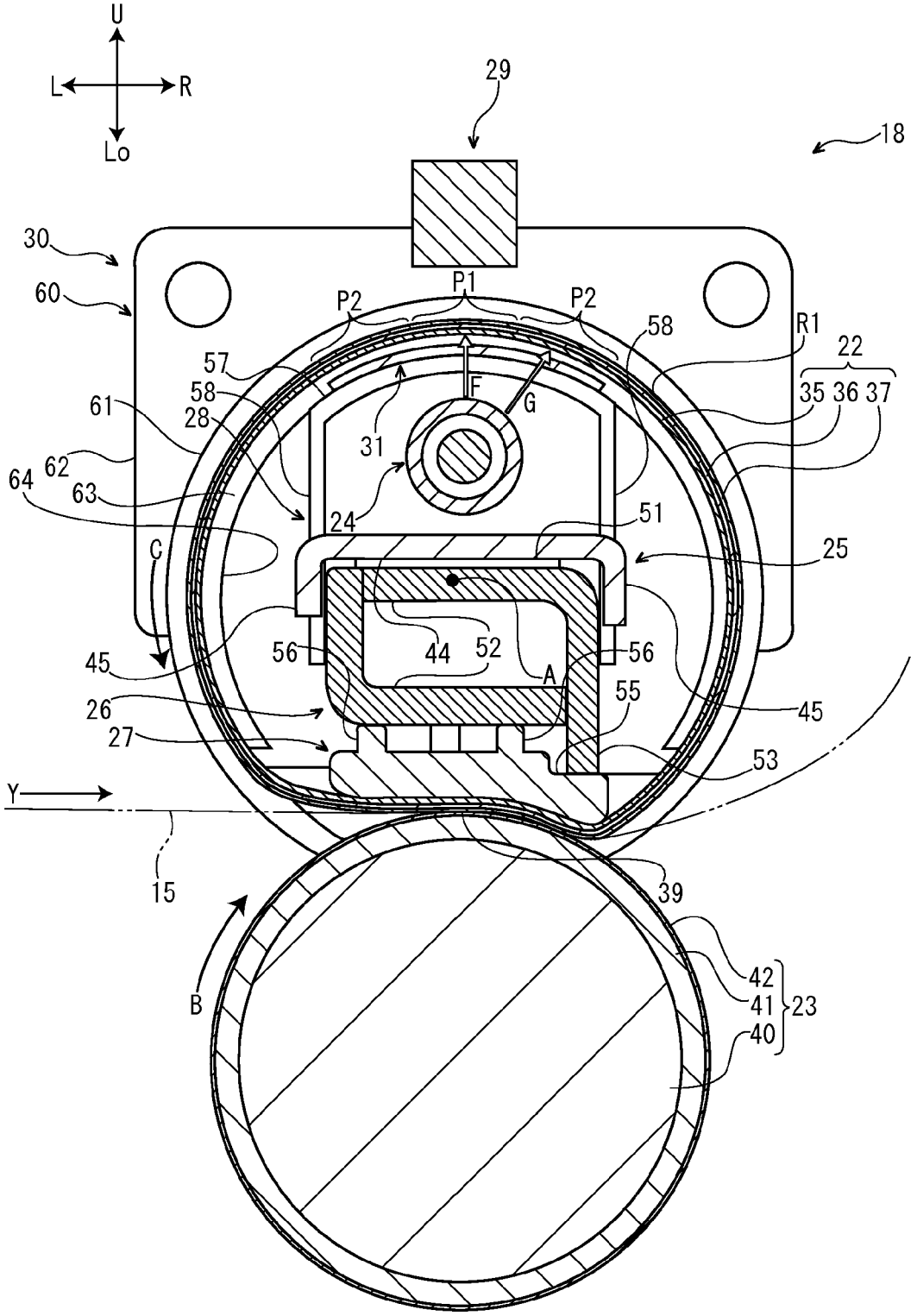
FIG. 7 is a side view showing a fixing device according to still another different embodiment of the present disclosure.

Further, in the other different embodiments, as shown in FIG. 7, the deformation preventing member 31 may be made of a material (e.g. silica glass) which has a higher rigidity than the rigidity of the fixing belt 22 and allows transmission of a radiation heat (infrared ray) radiated from the heater 24, and the inner circumferential faces of the first part P1 and each of the second parts P2 of the fixing belt 22 and the deformation preventing member 31 may face each other. By making the deformation preventing member 31 of a material which allows transmission of the radiation heat radiated from the heater 24 as described above, even when the deformation preventing member 31 is arranged so as to face the inner circumferential face of the first part P1 of the fixing belt 22, the radiation heat (see arrow Fin FIG. 7) traveling from the heater 24 toward the first part P1 of the fixing belt 22 is not blocked by the deformation preventing member 31. Similarly, also when the deformation preventing member 31 is arranged so as to face the inner circumferential face of each of the second parts P2 of the fixing belt 22, the radiation heat (see arrow G in FIG. 7) traveling from the heater 24 toward each of the second parts P2 of the fixing belt 22 is not blocked by the deformation preventing member 31. According to this, the heater 24 can efficiently heat the fixing belt 22. Further, the deformation preventing member 31 is arranged so as to face the inner circumferential faces of the first part P1 and each of the second parts P2 of the fixing belt 22, so that it is possible to enhance the function of preventing the fixing belt 22 from being deformed.

In addition, when the deformation preventing member 31 is made of a material which allows transmission of a radiation heat radiated from the heater 24 as described above, as shown in FIG. 7, the inner circumferential faces of the first part P1 and each of the second parts P2 of the fixing belt 22 and the deformation preventing member 31 may face each other, or the deformation preventing member 31 may face only the first part P1 of the fixing belt 22. That is, as long as the deformation preventing member 31 faces at least the first part P1 of the fixing belt 22, it is possible to enhance the function of preventing the fixing belt 22 from being deformed.

In the present embodiment, a case where the heater 24 composed of the halogen heater is used as a heat source has been described. Meanwhile, in the other different embodiments, a ceramic heater or the like may be used as the heat source.

In the present embodiment, a case where the configuration of the present disclosure is applied to the printer 1 has been described. Meanwhile, in the other different embodiments, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable around a rotation axis;

a pressuring member configured to be rotatable and to come into pressure contact with the fixing belt so as to form a fixing nip;

a heat source configured to heat the fixing belt;

a pressing member configured to press the fixing belt to a side of the pressuring member;

a heating stop device configured to face an outer circumferential face of the fixing belt and to operate at an operating temperature so as to stop the heat source from heating the fixing belt; and a deformation preventing member configured to face an inner circumferential face of the fixing belt;

in a state where the fixing belt is not broken in a circumferential direction, the fixing belt and the deformation preventing member are arranged at an interval, and when the fixing belt is broken in the circumferential direction, the fixing belt is deformed and comes into contact with the deformation preventing member so that the fixing belt is prevented from being deformed to a side far from the heating stop device.

2. The fixing device according to claim 1, wherein the fixing belt includes:

a first part which is the closest to the heat source; and second parts formed at both sides of the first part in a conveying direction of a recording medium, and the deformation preventing member does not face an inner circumferential face of the first part and faces an inner circumferential face of one of the second parts.

3. The fixing device according to claim 1, wherein the fixing belt includes:

a first part which is the closest to the heat source; and second parts formed at both sides of the first part in a conveying direction of a recording medium, and the deformation preventing member is made of a material which transmits radiant heat radiated from the heat source and faces an inner circumferential face of the first part.

4. The fixing device according to claim 1, wherein the fixing belt includes:

a base material layer;

an elastic layer provided around the base material layer; and a release layer configured to cover the elastic layer, and a thermal expansion rate of the deformation preventing member is larger than a thermal expansion rate of the base material layer of the fixing belt, and when the fixing belt is broken in the circumferential direction, the deformation preventing member is deformed by a thermal expansion so as to press the fixing belt toward aside of the heating stop device and the fixing belt comes into contact with the heating stop device.

5. The fixing device according to claim 1, wherein the deformation preventing member is provided over an entire region of the fixing belt in a direction of the rotation axis.

6. The fixing device according to claim 1, wherein the heat source is arranged at an inner diameter side of the fixing belt and provided at a position displaced from the rotation axis, and the heating stop device faces an outer circumferential face of a closest part to the heat source of the fixing belt.

7. The fixing device according to claim 1, further comprising shape restricting members attached to both end parts of the fixing belt and configured to restrict a shape of the fixing belt, wherein each shape restricting member includes:

a restricting piece which is at least partially inserted into each of the both end parts of the fixing belt; and a ring piece attached to the restricting piece and arranged at an outside in a direction of the rotation axis of each of the both end parts of the fixing belt.

8. The fixing device according to claim 7, wherein the restricting piece is provided with a through-hole formed along the direction of the rotation axis, and the heat source penetrates the through-hole.

9. The fixing device according to claim 1, wherein the heating stop device is provided at a position corresponding to a center part of the fixing belt in a direction of the rotation axis.

10. An image forming apparatus comprising the fixing device according to claim 1.

* * * * *